United States Patent [19]

Hanada et al.

[11] Patent Number: 4,827,691

[45] Date of Patent: May 9, 1989

[54] MACHINE FOR FILLING CONTAINERS WITH ROD-SHAPED OBJECTS

[75] Inventors: Mikio Hanada, Hasuda; Hideki Kobayashi, Numazu, both of Japan

[73] Assignee: Japan Tobacco Inc., Tokyo, Japan

[21] Appl. No.: 138,589

[22] Filed: Dec. 28, 1987

[30] Foreign Application Priority Data

Feb. 5, 1987 [JP] Japan ..... 62-23499

[51] Int. Cl.[4] ..... B65B 19/04

[52] U.S. Cl. ..... 53/151; 53/236; 53/245; 53/535; 221/200

[58] Field of Search ..... 53/151, 150, 149, 148, 53/236, 245, 535, 255, 260, 444; 221/93, 200, 225

[56] References Cited

U.S. PATENT DOCUMENTS

| | | | |
|---|---|---|---|
| 3,320,717 | 5/1967 | Molins et al. | 53/151 |
| 3,534,522 | 10/1970 | Liedtke | 53/236 X |
| 4,008,555 | 2/1977 | Ainoya et al. | 53/236 X |
| 4,487,001 | 12/1984 | Tolasch | 53/151 |
| 4,489,534 | 12/1984 | Gomann | 53/151 |
| 4,574,958 | 3/1986 | Manservisi | 53/151 X |
| 4,648,232 | 3/1987 | Brinker et al. | 53/151 X |

*Primary Examiner*—James F. Coan
*Attorney, Agent, or Firm*—Ladas & Parry

[57] ABSTRACT

A machine for filling a container with cigarettes comprises a supply hopper for holding the cigarettes, a discharge section arranged in the lower portion of the supply hopper and through which the cigarettes are discharged into the container. The discharge section includes a plurality of partition walls vertically arranged in at intervals, thereby defining discharge passages, a plurality of freely rotatable stop rollers each arranged directly under its corresponding partition wall and oblate in shape. When the stop rollers are at a first rotational position, their paired flat surface extending from both sides of their corresponding partition walls. When the stop rollers are at a second rotational position, the paired arc surface portions into their corresponding discharge passages.

9 Claims, 7 Drawing Sheets

MACHINE FOR FILLING CONTAINERS WITH ROD-SHAPED OBJECTS

BACKGROUND OF THE INVENTION

The present invention relates to a machine for supplying rod-shaped objects such as cigarettes from a supply hopper into a container.

As a filling machine of this type, apparatuses . disclosed in U.S. Pat. Nos. 4,487,001 and 4,489,534 are well known. These apparatuses comprise a supply hopper in which a plurality of cigarettes are horizontally stored, and two rows of rod members arranged in the lower portion of the supply hopper. The rod members in each row are located in the horizontal direction at intervals. The adjacent rod members in each row define a discharge passage for the cigarettes. The discharge passages defined in the upper row are vertically aligned with corresponding ones defined in the lower row. Therefore, the cigarettes in the supply hopper can be discharged downward, keeping their horizontal pose and passing through the upper and lower discharge passages.

In the case of this filling machine, the container in which the cigarettes are to be filled is positioned right under the supply hopper. The cigarettes discharged through the supply hopper are successively piled in the container. Further, the container can be successively lowered according to the height of the cigarettes piled in the container. As is described above, if the container is successively lowered, the distance of the cigarettes falling in the container or on the cigarettes already piled in the container can be made as short as possible when the cigarettes are filled in the container. As the result, the cigarettes can be piled in the container, keeping reliably their horizontal pose as in the supply hopper.

In the case of the above-described machines, however, the adjacent cigarettes in the supply hopper apt to simultaneously enter a discharge passage in the upper row during the filling process. In this case, the discharge passage is closed by the cigarettes. Therefore, the filling of the cigarettes from the supply hopper into the container cannot be attained smoothly.

When the discharge of the cigarette through the discharge passages of the upper row is not carried out smoothly like this, the cigarettes cannot be orderly piled in the container, thereby reducing the number of the cigarettes filled in the containers.

When the container is made full of the cigarettes, it is necessary to stop the supply of the cigarettes from through the supply hopper to the container, while the fully filled container must be exchanged with an empty one. In the case of the above-described machines, the rod members which form one of the upper and lower rows are shifted in the horizontal direction and then positioned on the axial lines of the corresponding discharge passages of the other row. The discharge passages of the other row are thus closed by the rod members shifted, thereby stopping the supply of the cigarettes the supply hopper to the container. When the rod members of one row are shifted in this manner, however, some of the cigarettes which intend to be discharged from the supply hopper are sometimes sandwiched between the rod members of the upper and lower rows, thereby damaging these cigarettes.

SUMMARY OF THE INVENTION

The object of the present invention is therefore to provide a rod-shaped objects filling machine capable of smoothly discharging rod-shaped objects into container, piling them in perfect order in the container, and preventing the rod-shaped objects from being damaged when the discharging of the rod-shaped objects from the supply hopper is stopped.

The object described above can be achieved by a rod-shaped objects filling machine according to the present invention. The filling machine comprises a discharge means arranged at the lower portion of the supply hopper. The discharge means includes a plurality of partition walls which are arranged in the horizontal direction at intervals so as to define discharge passages between them. Each discharge passage extends in the vertical direction. The discharge means further includes a plurality of agitator rollers rotatably located at right above the upper surfaces of the partition walls in order to introduce the rod-shaped objects in the supply hopper into the discharge passages by their rotation, and a plurality of stop rollers rotatably located at right under the lower surface of the partition walls. Each of the stop rollers is made oblate and its circumference includes a pair of parallel flat surfaces. Each stop roller is positioned in such a way that its flat surfaces are continuous from both sides of its corresponding partition wall when the rod-shaped objects are supplied from the supply hopper. Therefore, the adjacent stop rollers define an extended portion of the corresponding discharge passage. When these stop rollers are rotated in a same direction by 90°, they project their paired arc surface into the discharge passages to narrow the discharge passages at the lower ends thereof, thereby preventing the cigarettes from being discharged through the discharge passages.

When the above-described discharge means is provided, the rod-shaped objects in the supply hopper can be positively introduced into the discharge passages by the rotation of the agitator rollers and they can be thus smoothly discharged through the discharge passages. When a container is located under the above-described discharge means, therefore, the rod-shaped objects in the supply hopper can be discharged into the container, passing through the discharge passages and keeping their horizontal pose, and uniformly distributed and piled in perfect order in the container. The container is successively lowered, depending upon the amount of the rod-shaped objects filled, until it is made full of the rod-shaped objects. When the container is made full of the rod-shaped objects like this, the oblate stop rollers are rotated by 90° in a same direction. The discharge passages of the discharge means are thus closed by these stop rollers, as described above, so that the discharge of the rod-shaped objects through the discharge passages or from the supply hopper can be stopped. As described above, the stop rollers are rotated in the same direction to close the discharge passages in the discharge means and no rod-shaped object is therefore sandwiched between the adjacent stop rollers, thereby reliably preventing the rod-shaped objects from being damaged. According to the present invention, the filling machine can be provided with a plurality of aligning rods arranged under the stop rollers and in the horizontal direction at intervals. They can reciprocate in the horizontal direction at a certain stroke. The rod-shaped objects which are to be piled in the container are reliably made even every pile in the container by the reciprocation of the aligning rods, so that the rod-shaped objects can be successively piled and orderly filled in the container.

The above-mentioned container is like a box opened both at the top and at the front side thereof. When this container is used, the filling machine of the present invention can be provided with a guide plate arranged to close a part of the opened front side of the container. This guide plate can reciprocate in the axial direction of the rod-shaped objects and serves to align ends of the rod-shaped objects, which have been piled in the container, along a same vertical plane. When this guide plate is employed, the piling or filling of the rod-shaped objects in the container can be made perfect both in the radical and axial directions of the rod-shaped objects.

DETAILED DESCRIPTION OF THE PREFERRED EMBODIMENTS

Figure 1:
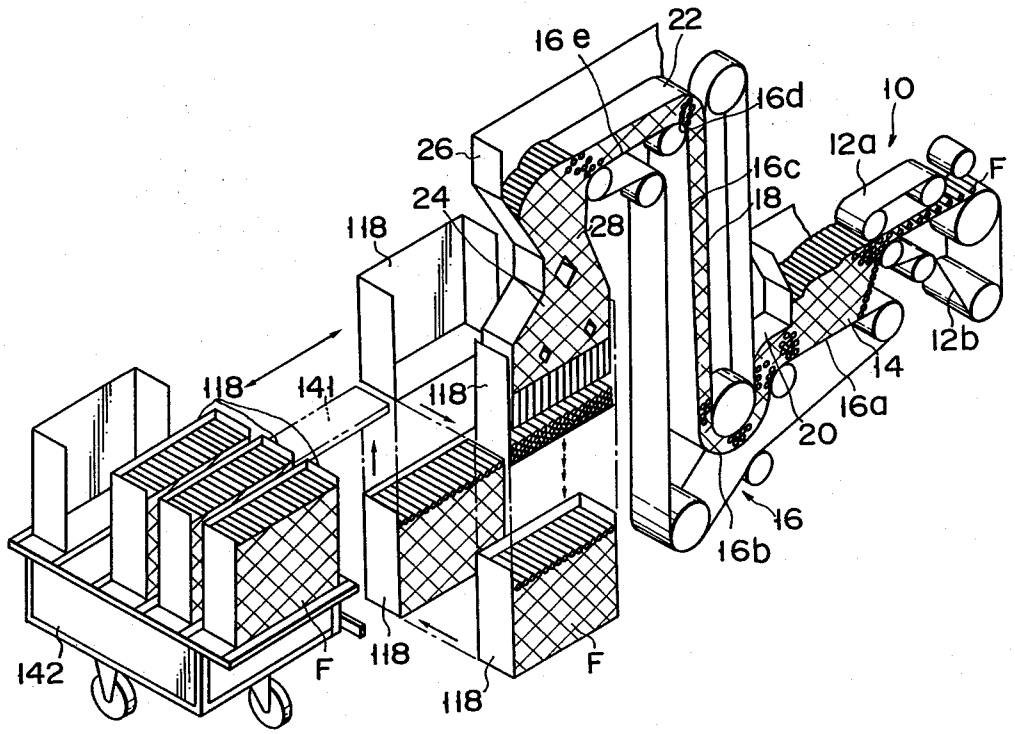
FIG. 1 shows the whole of the system including an example of a cigarettes filling machine according to the present invention.

FIG. 1 shows roughly the whole of the system provided with an example of the filling machine according to the present invention to fill a container with cigarettes. The system is connected to the cigarette producing apparatus, from which cigarettes are supplied to the system. The system is therefore provided with cigarette receiving section 10. Cigarette receiving section 10 has a pair of belt conveyers 12*a* and 12*b* opposed to each other with a certain distance in the vertical direction. Filtertip cigarettes F are supplied one by one between conveyers 12*a* and 12*b* from the cigarette producing apparatus in such a manner that the cigarettes are arranged perpendicular to the running direction of conveyers 12*a* and 12*b*. Cigarettes F are conveyed by belt conveyers 12*a* and 12*b* Reservoir 14 is arranged at the end of the belt conveyers 12*a* and 12*b*. Cigarettes F conveyed between conveyers 12*a* and 12*b* are thus stored in reservoir 14 temporarily.

The bottom of reservoir 14 is formed by a part of endless belt conveyer 16. Belt conveyer 16 includes lower horizontal portion 16*a* which serves as the bottom of reservoir 14, elevator portion 16*c* continuous from upper horizontal portion 16*a* via curved portion 16*b* and extending upward in the vertical direction, and upper horizontal portion 16*c* continuous from the elevator portion 16*c* via curved portion 16*d*. Auxiliary conveyer 18 which is an endless sponge belt is arranged adjacent to elevator portion 16*c* of conveyer 16 and parallel to it with a certain distance. Elevator portion 16*c* and auxiliary conveyer 18 form a passage between them through which cigarettes F are elevated. Further, guide plate 20 is arranged between reservoir 14 and auxiliary conveyer 18, above belt conveyer 16 with a certain distance, and another guide plate 22 is also arranged between curved portion 16*d* and the end of upper horizontal portion 16*e*, above upper horizontal portion 16 with a certain distance. When the system is provided with belt conveyer 16 and auxiliary conveyer 18, therefore, cigarettes F in reservoir 14 are successively fed out of it by running of these conveyers 16 and 18. The cigarettes F thus fed from reservoir 14 are then sandwiched and elevated between elevator portion 16*c* of conveyer 16 and auxiliary conveyer 18 to come to upper horizontal portion 16*e* of conveyer 16. As roughly shown in FIG. 1, cigarettes F are fed in multilayers (about 8 layers) from reservoir 14. Reservoir 14 is provided with a detector (not shown) for detecting the amount of cigarettes stored in reservoir 14, and the supply of cigarettes F from the cigarette producing apparatus to reservoir 14 can be controlled by this detector. Those portions of the system which are shaded by oblique lines in FIG. 1 represent places where the cigarettes F are stored and the conveying passage through which cigarettes F are conveyed. Side guide plates by which the conveying passage is defined together with the guide plates 20, 22 and the like are not shown in FIG. 1 except a part thereof.

Figure 2:
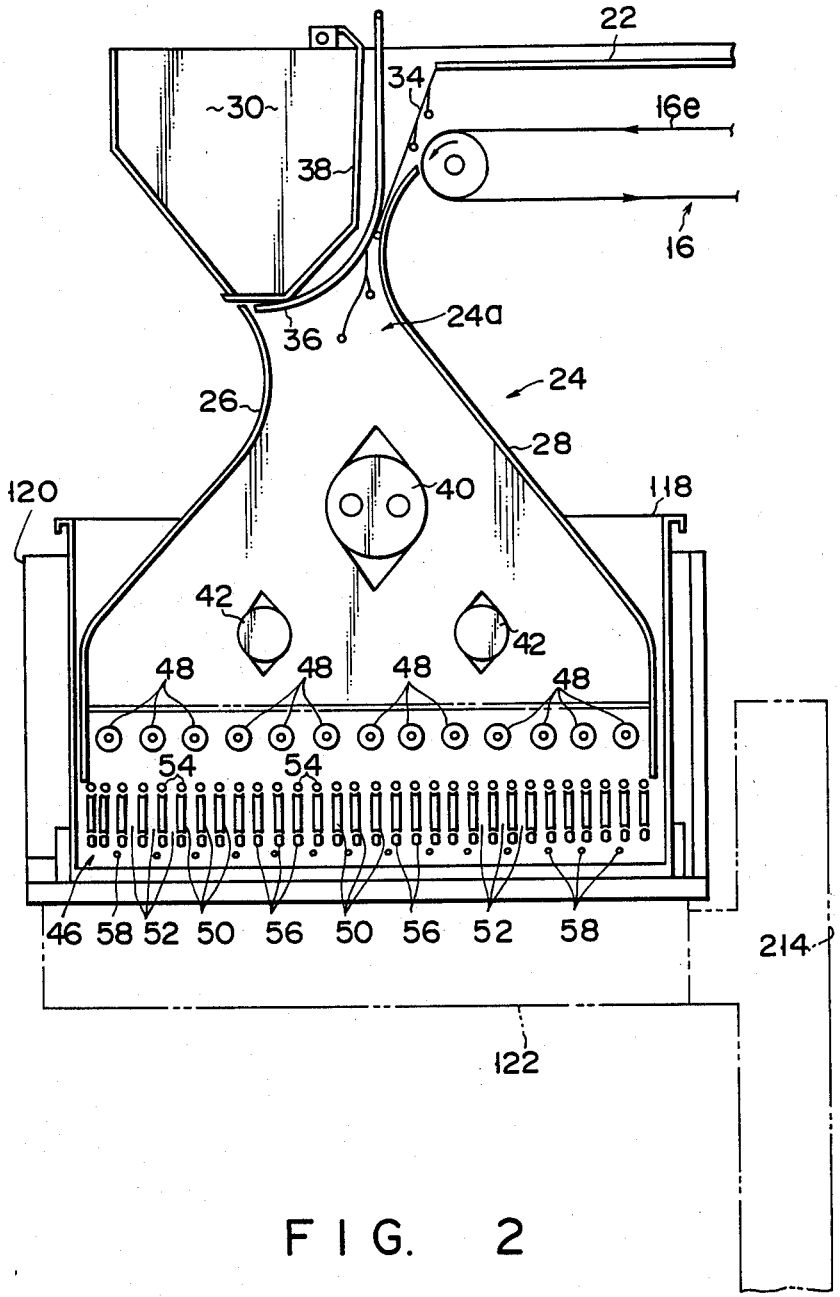
FIG. 2 is an enlarged view showing a supply hopper and a discharge section.

Arranged below upper horizontal portion 16*e* of conveyer 16 is a supply hopper 24 which is shown in detail in FIG. 2. Supply hopper 24 includes a pair of side guide plates 26, 28 (when seen in FIG. 2), and back and front plates 30, 32 (see FIG. 3) for connecting side guide plates 26 and 28. Side guide plates 26 and 28 are made narrower between them in the center thereof. In short, supply hopper 24 has a neck 24*a* in the center thereof. The upper end of side guide plate 28 positioned right in FIG. 2 is arranged close to the end of upper horizontal portion 16*e* of conveyer 16, as shown in FIG. 2, so that cigarettes F discharged through an opening between upper horizontal portion 16*e* and guide plate 22 can be introduced into supply hopper 24. Sheet 34 is attached to the end of guide plate 22 to control the dropping of cigarettes F. Sheet 34 is provided with plural weights and usually hung downward or into supply hopper 24 from guide plate 22. Guide arm 36 for cigarettes F is arranged adjacent to sheet 34 and freely swingably supported at the upper end thereof. Cigarettes F discharged through the opening between upper horizontal portion 16*e* and guide plate 22 can be thus smoothly introduced into supply hopper 24 by sheet 34 and guide arm 36. More specifically, each of cigarettes F can be dropped into supply hopper 24 with its pose held horizontal.

Freely swingably arranged at the upper portion of supply hopper 24 is detecting lever 38 to detect the amount of cigarettes F stored in supply hopper 24. As the amount of cigarettes F is increased more and more in supply hopper 24, detecting lever 38 is swung upward together with sheet 34 and guide arm 36 by cigarettes F stored, taking its upper end as the center of its swinging movement. The position of detecting lever 38 swung or amount of cigarettes F in supply hopper 24 is detected by a detecting switch (not shown).

Discharge section 46 is arranged in the lower portion of supply hopper 24. Before this discharge section 46 is described, supply hopper 24 will be explained a little more about its inside. Supply hopper 24 includes a first separating guide 40 between neck 24*a* and discharge section 46, and a pair of second separating guides 42 positioned at right and left under sides of first separating guide 40. Each of separating guides 40 and 42 is spindly shape in section and cigarettes F introduced into supply hopper 24 are distributed by these first and second separating guides 40 and 42 during their falling in supply hopper 24.

Figure 6:
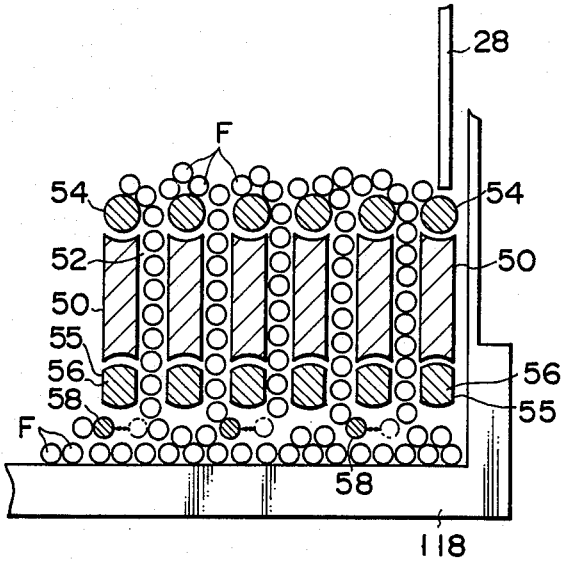
FIGS. 6 and 7 are enlarged sectional views showing how cigarettes are filled in a container.
Figure 7:
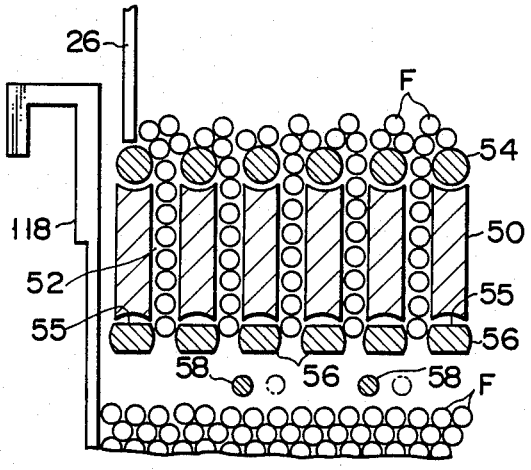

Discharge section 46 forms the bottom of supply 24 and the cigarettes F are thus uniformly piled on discharge section 46. Discharge section 46 includes plural center rollers 48 positioned below second separating guides 42. These center rollers 48 are rotatably arranged at intervals in the width direction of supply hopper 24 or in the horizontal direction. A plurality of vertical partition walls 50 are arranged under center rollers 48 at intervals. Each of partition walls 50 is made of a plate member extending in a direction perpendicular to back guide 30 and adjacent partition walls 50 define discharge passage 52 through which cigarettes F are passed. The interval between adjacent partition walls 50 is set to have such a width that allows cigarettes F to pass through one by one. The top and bottom surfaces of each partition wall 50 are curved like an arc to form groove extending in the direction perpendicular to back guide 30 (see FIG. 4). Agitator roller 54 is rotatably arranged directly above the top surface of each partition wall 50. The interval between adjacent agitator rollers 54 is set substantially same as that between adjacent partition walls 50. Stop roller 56 is rotatably arranged directly under the bottom surface of each partition wall 50. Different from agitator rollers 54 each shaped like a true circle, each of stop rollers 56 is made to have an oblate shape. More specifically, each of stop rollers 56 is a cylinder having a little larger diameter than that of agitator roller 54 and two parallel flat surfaces 55 on its circumference. When stop rollers 56 are rotated to direct their paired flat surfaces 55 vertical, they form extended portions of their corresponding partition walls 50, as shown in FIG. 6. In short, adjacent stop rollers 56 define an extended portion of each discharge passage 52. When stop rollers 56 are rotated by 90° in same direction, however, both arc portions of each stop roller 56 project a little into their corresponding discharge passages 52 to thereby stop the flow of cigarettes F passing through discharge passages 52, as shown in FIG. 7.

Discharge section 46 further includes plural aligning rods 58 positioned under stop rollers 56. Adjacent aligning rods 58 are arranged at intervals in the horizontal direction, as seen in the case of stop rollers 56, and aligning rods 58 can reciprocate in the horizontal direction at a certain stroke. In this embodiment, aligning rods 58 are arranged every two stop rollers.

Figure 3:
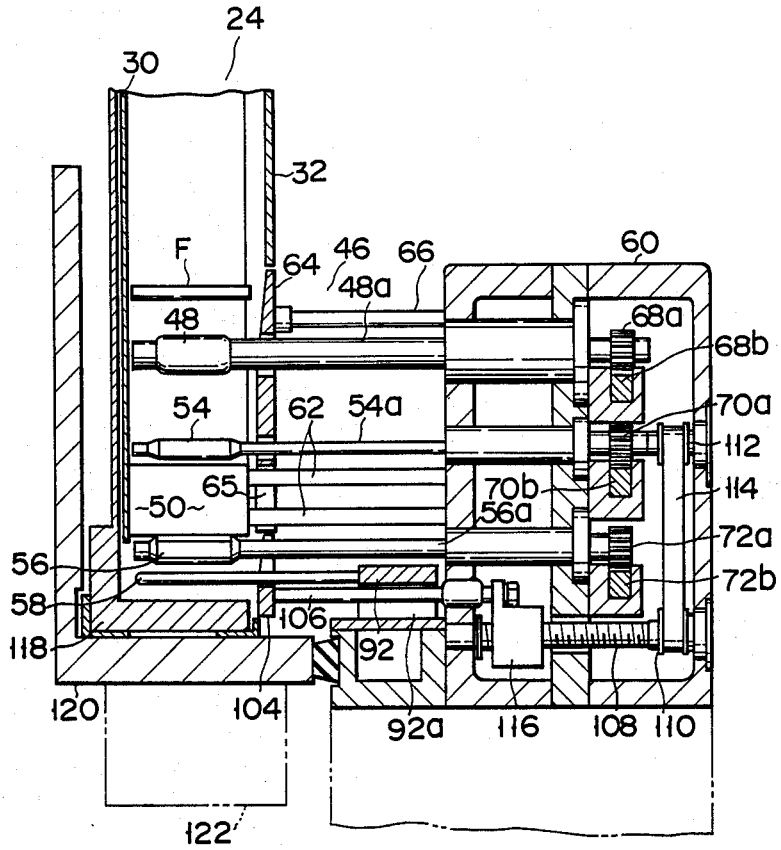
FIG. 3 is a sectional view showing both of the supply hopper and the discharge section.
Figure 4:
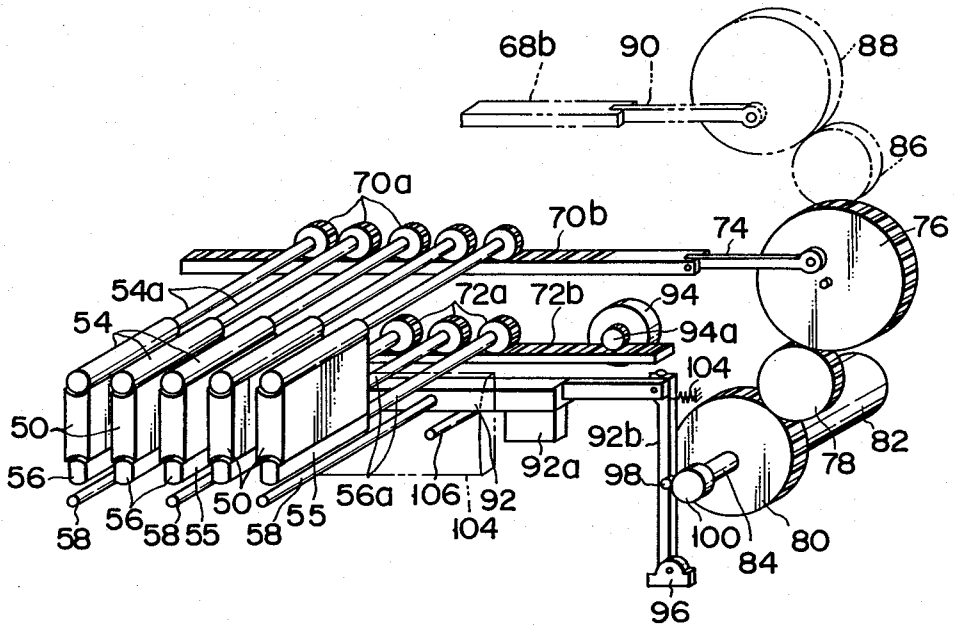
FIG. 4 is a perspective view showing a part of the discharge section.

Referring to FIGS. 3 and 4, there will be described a mechanism for driving the above-mentioned rollers 48, 54, 56 and aligning rods 58. Roller shafts 48*a*, 54*a* and 56*a* for these rollers 48, 54 and 56 extend parallel to one another in the forward direction of supply hopper 24, as shown in FIG. 3. These roller shafts 48*a*, 54*a* and 56*a* are rotatably supported like a cantilever by housing 60 for the driving mechanism. As apparent from FIG. 3, a pair of support rods 62 extend toward each of partition walls 50, which is supported by housing 60 through these support rods 62. Further, guide plate 64 which constitutes the lower portion of front plate 32 of supply hopper 24 is supported by the housing 60 through plural support rods 66. Guide plate 64 is provided with through-holes or cut-away portions 65 through which roller shafts 48*a*, 54*a* and 56*a* are passed, as shown in FIG. 3.

Pinions 68*a*, 70*a* and 72*a* are attached to the ends of roller shafts 48*a*, 54*a* and 56*a*, respectively, and these pinions 68*a*, 70*a* and 72*a* are meshed with their corresponding racks 68*b*, 70*b* and 72*b*, which are slidably supported in housing 60 and can move in a direction perpendicular to the axis each of the roller shafts.

The rack 70*b* is connected to a gear 76 through crank arm 74, as shown in FIG. 4. This gear 76 is meshed with a driving gear 80 through intermediate gear 78. Driving gear 80 is mounted to output shaft 84 of driving motor 82. When motor 82 is drived, the rotation of driving gear 80 is transmitted to gear 76 via intermediate gear 78, thereby causing gear 76 to be rotated in one direction. The rotation of gear 76 is converted to the reciprocation of rack 70*b* by means of crank arm 74, thereby causing agitator rollers 54 to be rotated in the forward and reverse directions through the pinions 70*a* and roller shafts 54*a*. Although shown by broken lines in FIG. 4, rack 68*b* which is associated with center rollers 48 is connected to gear 88 through crank rm 90. Gear 88 is meshed with gear 76 via intermediate gear 86. Therefore, center rollers 48 are also rotated in the forward and reverse directions, as seen in the case of agitator rollers 54.

Directly meshed with rack 72*b* which is associated with stop rollers 56 is driving pinion 94*a*, which is mounted to output shaft of forward- and reverse-rotatable rotary actuator 94. When driving pinion 94*a* is rotated certain times by rotary actuator 94, therefore, stop rollers 56 are rotated by 90°, as described above, through rack 72*b*, pinions 72*a* and roller shafts 56*a*.

Aligning rods 58 are connected to horizontal arm 92 positioned between supply hopper 24 and housing 60, as shown in FIG. 3. Horizontal arm 92 is supported to freely reciprocate in the same direction as in the case of the above-mentioned racks. A means for supporting horizontal arm 92 is not shown. One end of horizontal arm 93 is pivoted on the upper end of cam lever 92*b*, as shown in FIG. 4. Cam lever 92*b* extends downward and it is pivoted on fixed bracket 96 at the lower end thereof. Cam follower 98 is rotatably mounted to the center of cam lever 92*b* Cam 100 is brought into contact with cam follower 98. Cam 100 is mounted on the foremost end of the output shaft of motor 82. One end of return spring 102 is connected to cam lever 92*b* while the other end to a fixed wall (not shown). Cam follower 98 is thus urged by return spring 102 to usually contact with cam 100. When cam 100 is rotated by driving motor 82, therefore, cam lever 92*b* is swung by a certain angle, so that horizontal arm 92 or aligning rods 58 can be reciprocated by a certain stroke or only by the width of partition wall 50, for example, as described above.

As shown in FIG. 3, ordering guide plate 104 is arranged under guide plate 64. Ordering guide plate 104 constitutes a part of front plate 32 for supply hopper 24, similarly to the case of guide plate 64, but it can be reciprocated in the axial direction of or forward and backward along the longitudinal direction of cigarettes F in supply hopper 24, differently from guide plate 64. Ordering guide plate 104 is supported by housing 60 through plural support rods 106. These support rods 106 are shidably passed the wall of housing 60 and can be moved forward and backward in relation to housing 60. As shown in FIG. 4, support rods 106 extend from ordering guide plate 104 to housing 60, passing under horizontal arm 92, and they do not hinder the reciprocation of horizontal arm 92, accordingly. Horizontal arm 92 is therefore supported on its support means via slide bearings 92*a* only at the both ends thereof. Ordering guide plate 104 is provided with cut-away portions or slits at the upper portion thereof so as not prevent aligning rods 58 from reciprocating in the horizontal direction.

Feed screw 108 are rotatably supported in housing 60, as shown in FIG. 3. Pulley 110 is mounted to one end of feed screw 108. Pulley 112 which is associated with pulley 110 is mounted to the end of one roller shaft 54*a* for agitator rollers 54, and driving belt 114 is stretched between these pulleys 110 and 112. Carrier 116 whose rotation is stopped is screwed onto feed screw 108 and connected to one end of support rod 106 which is projected into housing 60. When agitator rollers 54 are rotated forward and backward, as described above, therefore, their forward and backward rotations are transmitted to feed screw 108 through pulleys 110, 112 and driving belts 114, and then feed screw 108 are rotated forward and backward accordingly. Carrier 116 are thus reciprocated on feed screws 108, so that ordering guide plate 104 can be reciprocated forward and backward by the support rods 106.

Container 118 is positioned under supply hopper 24. As roughly shown in FIG. 1, container 118 is a box opened at the top and front side thereof. Container 118 shown in FIG. 2 is positioned so as to enclose the lower portion of supply hopper 24 from the back of hopper 24. In the case of container 118 shown in FIGS. 2 and 3, therefore, its inner bottom is located right under aligning rods 58.

On the other hand, container 118 is held on mother tray 120, and mother tray 120 is put on platform 122. Platform 122 can be elevated and it is positioned at the highest position when it is seen in FIGS. 2 and 3.

Figure 5:
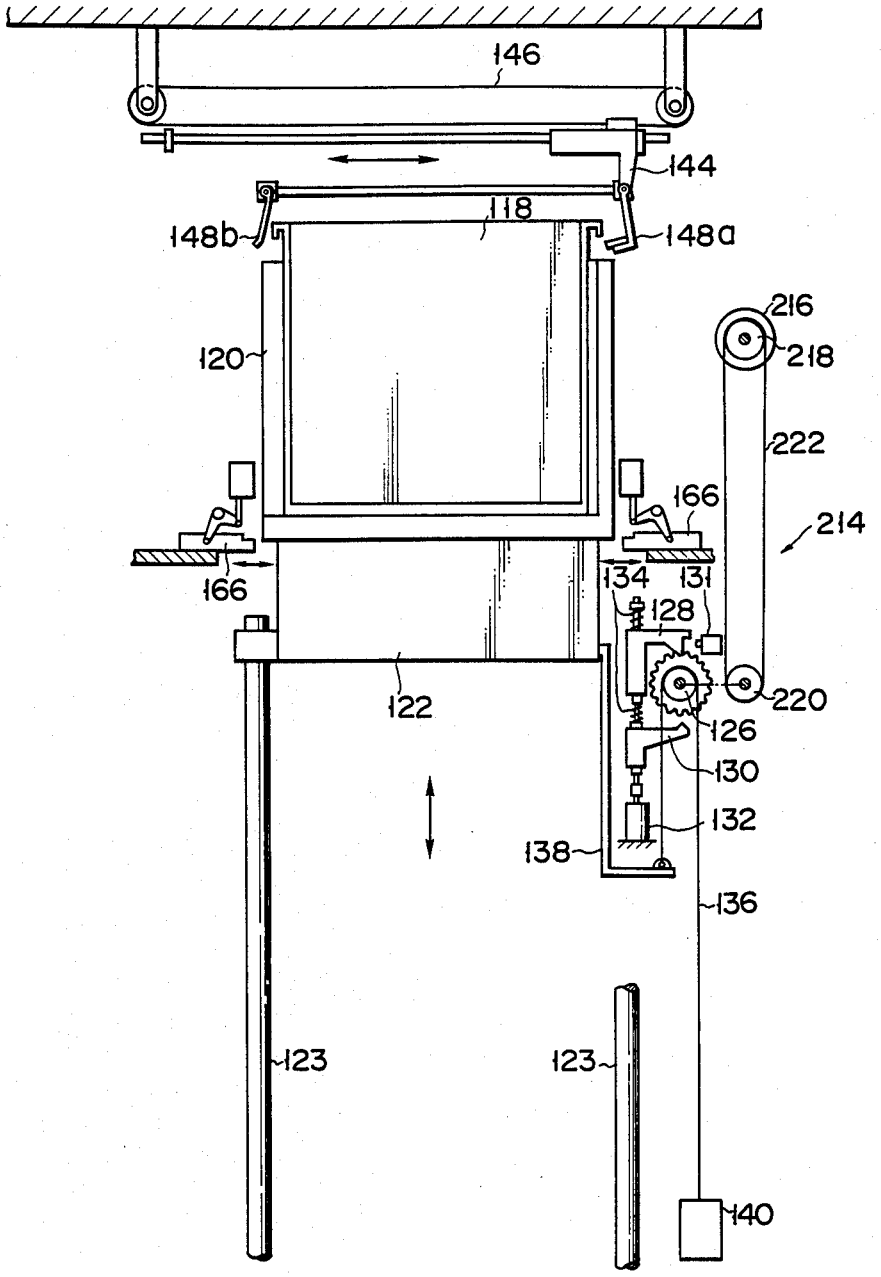
FIG. 5 is a sketch showing a lift mechanism at the platform.

Elevator mechanism 214 for platform 122 will be described referring to FIG. 5. Elevator mechanism 214 includes a forward- and reverse-rotatable rotary actuator 216 fixed to a base (not shown). Sprocket 218 is attached to the output shaft of rotary actuator 216. In the case of an example shown in FIG. 5, another sprocket 220 which is associated with sprocket 218 is arranged under rotary actuator 216. Chain 222 is stretched between these sprockets 218 and 220.

Star wheel 124 and a sprocket 126 are coaxially attached to the shaft of sprocket 220. For the sake of simplicity, FIG. 5 shows sprocket 220 separated from star wheel 124 and sprocket 126. Star wheel 124 has a plurality of teeth on its whole circumference. A pair of ratchets 128 and 130 are arranged above and below star wheel 124, sandwiching star wheel 124 between them. These ratchets 128 and 130 can be moved up and down synchronizing with the action of air cylinder 132. In FIG. 5, ratchet 128 positioned at upper side is engaged with star wheel 124 to prevent the rotation of the latter. Numeral 134 represents return springs for ratchets 128 and 130.

Chain 136 is hung from sprocket 126 which is coaxially attached together with star wheel 124. One end of chain 136 is connected to platform 122 via connecting bracket 138, while the other end thereof to a weight 140 having a certain weight.

According to elevator mechanism 214 having such an arrangement as described above, ratchets 128 and 130 are alternately engaged with star wheel 124 every certain time interval, depending upon the action of air cylinder 132. During such a time period that begins when one of ratchets is released from star wheel 124 and ends when the other ratchet is engaged with star wheel 124, therefore, star wheel 124 can be left freely rotatable, so that platform 122 can fall intermittently by a certain distance together with mother tray 120 and container 118 thanks to its own weight. In order to elevate platform 122 to the highest position after platform 122 reaches the lowest position, air cylinder 132 is contracted at first to release ratchet 130 from star wheel 124. At the same time when ratchet 130 is released, another air cylinder 131 fixed adjacent to ratchet 128 is stretched and the piston rod of this air cylinder 131 is engaged with ratchet 128, thereby preventing ratchet 128 from being engaged with star wheel 124 by return spring 134. When rotary actuator 216 is rotated under this state, sprocket 126 is rotated together with star wheel 124 to elevate platform 122 through chain 136. Numeral 123 in FIG. 5 represents guide rods for guiding platform 122.

The filling of cigarettes F from supply hopper 24 into container 118 will be described referring to FIGS. 6 and 7. As shown in FIG. 6, empty container 118 is positioned right under supply hopper 24 or at its highest position. When stop rollers 56 are directed to form extended portions of partition walls 50 at this time, as shown in FIG. 6, cigarettes F in supply hopper 24 fall downward onto the bottom of container 118, passing through discharge passages 52 defined between partition walls 50. Center and agitator rollers 48 and 54 are being rotated forward and backward also at this time. Therefore, cigarettes F in supply hopper 24 are dragged and introduced into discharge passages 52 mainly by the rotating action of agitator rollers 54. As a result, cigarettes F in supply hopper 24 are uniformly discharged through discharge passages 52, thereby enhancing the efficiency for filling container 118 with cigarettes F every an hour.

Cigarettes F which have been discharged through discharge passages 52 are successively piled in container 118. Aligning rods 58 positioned under stop rollers 56 are being reciprocated in the horizontal direction during this discharging process of cigarettes F into container 118, as shown in FIG. 6. Therefore, cigarettes F which have been discharged into container 118 are made even by the reciprocation of these aligning rods 58, thereby enabling cigarettes F to be orderly stacked in container 118.

On the other hand, container 118 is successively and intermittently dropped by above-described elevator mechanism 214, depending upon the amount of cigarettes F supplied into container 118, and this enables cigarettes F to be piled in perfect order in container 118 until container 118 becomes full with the thus-piled cigarettes F. Further, while container 118 is being intermittently dropped, ordering guide plate 104 is also reciprocated forward and backward, following center and agitator rollers 48 and 54 rotated forward and backward. Ends of cigarettes F in container 118 can be thus ordered along a same vertical plane by ordering guide plate 104.

When container 118 becomes full of cigarettes F, as shown in FIG. 7, stop rollers 56 are rotated by 90° in the same direction. All of discharge passages 52 are thus closed, as shown in FIG. 7, the supply of cigarettes F from supply hopper 24 into container 118 is stopped. Stop rollers 56 are synchronizingly rotated in the same direction. Therefore, none of cigarettes F is sandwiched between stop roller 56 and partition wall 50, thereby preventing any of cigarettes F from being damaged.

Container 118 which has been filled with cigarettes F is conveyed from under supply hopper 24 and putted on a cart 142. Empty container 118 is then supplied from cart 142 to supply hopper 24 and located at its above-described highest position. The cigarette filling process is repeated thereafter, as described above.

Figure 8:
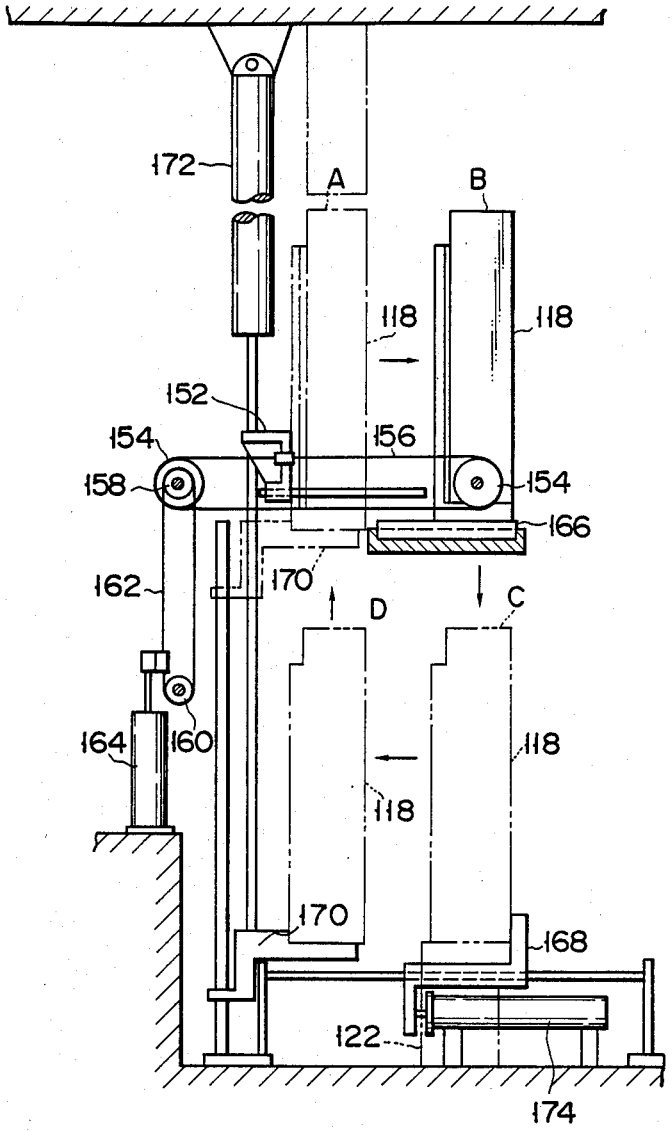
FIG. 8 is a sketch showing how containers are conveyed in and out of the system.

The movement of container 118 between cart 142 and supply hopper 24 will be described in brief, referring to FIGS. 5 and 8. As shown in FIG. 5, carrier 144 for container 118 is arranged above supply hopper 24 (which is not shown in FIG. 5). Carrier 144 can be reciprocated between supply hopper 24 and cart 142, using endless chain 146 supported by the ceiling. Carrier 144 has a pair of chucks 148a and 148b which enable it to clasp container 118. When carrier 144 is moved above cart 142, therefore, it can clasp one empty container 118 on cart 142 by means of its chucks **148*a* and 148*b*. When carrier 144 is then returned, empty container 118 is guided on a rail plate 141 which extends from cart 142 to supply hopper 24, and held on mother tray, as shown in FIGS. 2 and 3. Mother tray 120 is then located at that position A which is behind supply hopper 24, as shown in FIG. 8. Mother tray 120 is also putted on elevator table 170 in this time, which will be described later. Empty container 118 is then forwarded together with mother tray 120 by forward pusher 152, thereby causing empty container 118 to be located at the highest position shown in FIG. 2, that is, at that position B which is shown in FIG. 8. Driving mechanism for forward pusher 152 is shown in FIG. 8 and it comprises a pair of sprockets 154 separated from each other before and behind pusher 152, endless chain 156 connected to forward pusher 152 and stretched between sprockets 154, sprocket 158 coaxially attached to one of sprockets 154, sprocket 160 positioned under sprocket 158, endless chain 162 stretched between sprockets 158 and 160, and air cylinder 164 connected to chain 162. When driving mechanism for forward pusher 152 has such an arrangement as described above, forward pusher 152 can be moved forward and backward via chains 162 and 156 by the action of air cylinder 164. When empty container 118 is to be pushed by forward pusher 152, a pair of guide rails 166 shown in FIG. 5 are previously operated and positioned in front side of mother tray 120 by means of air cylinders to thereby guide mother tray 120. When empty container 118 is moved from position A to position B, another empty container 118** will be located at position A.

As described above, container 118 located at position B is filled with cigarettes F and as it is filled with more and more cigarettes F, it is lowered together with mother tray 120 from position B to position C, following the falling of platform 122. When container 118 which has been full of cigarettes F reaches position C, the supply of cigarettes F from supply hopper 24 into container 118 is stopped, as described above, and the other empty container 118 located at position A is then moved to position B by forward pusher 152 and held there by paired guide rails 166. Elevator table 170 is then lowered to that position which is shown by a solid line in FIG. 8.

On the other hand, container 118 which has been full of cigarettes F is moved together with the mother tray 120 by backward pusher 168, which is driven by air cylinder 174. Filled container 118 is thus putted on elevator table 170 and then located at position D. A pair of guide rails (not shown) similar to those 166 are used to guide container 118 from position C to position D. Filled container 118 which has been located together with mother tray 120 at position D is moved to position A in FIG. 8 by rising elevator table 170. Platform 122 is lifted from its lowered position to its highest position at the same time, thereby causing empty container 118 to be putted on platform 122 together with mother tray 120. Mother tray 120 is released from paired guide rails 166 at this time and the cigarette filling process is repeated relative to empty container 118, as described above.

Fully filled container 118 which has been located at position A is guided on guide rail 141 and moved from mother tray 120 onto cart 142 by carrier 144. After fully filled container 118 is returned onto cart 142, this cart 142 is forwarded by such a distance that corresponds to one container so as to enable an empty container 118 thereon to be picked up on guide rail 141. Thereafter, a new empty container 118 is similarly supplied form cart 142 to position A and held there and then moved according to the above-described process.

What is claimed is:

1. A machine for supplying rod-shaped objects in container comprising:

a supply hopper in which a plurality of the rod-shaped objects are horizontally stacked and housed;

a discharge section arranged in the lower portion of said supply hopper, said discharge section including a plurality of partition walls arranged at intervals, and defining discharge passages through which the rod-shaped objects pass one by one, guiding means for smoothly guiding the rod-shaped objects in the supply into the discharge passages, a plurality of stop rollers, each rotatably arranged directly under its corresponding partition wall and shaped such that when said stop rollers are at a first rotational position, their corresponding discharge passages are fully opened at the lower ends thereof while when said stop rollers are at a second rotational position, said stop rollers project themselves into their corresponding discharge passages to reduce the width of each of the discharge passages, so that discharging of the rod-shaped objects through the discharge passages can be prevented, and rotating means for rotating said stop rollers to either the first or the second rotational position;

said container being arranged to enclose the lower portion of said supply hopper and receive the rod-shaped objects discharged through the discharge passages of said discharge section; and means for gradually lowering said container as it is filled with more and more rod-shaped objects.

2. A machine according to claim 1, wherein each of said stop rollers is formed by cutting away a cylindrical rod member to form a pair of flat surfaces parallel to each other and a pair of arc surfaces, and when said stop rollers thus formed are in the first rotational position, their paired flat surfaces extending from both sides of their corresponding partition walls.

3. A machine according to claim 2, wherein each of the partition walls has a semi-circular groove on its lower surface end to conform to the arc surfaces of its corresponding one of said stop rollers.

4. A machine according to claim 3, wherein said rotating means simultaneously rotate all of said stop rollers in a same direction, from the first rotational position to the second rotational position.

5. A machine according to claim 1, wherein said guiding means includes plural agitator rollers each of which is rotatably arranged directly above its corresponding partition wall.

6. A machine according to claim 5, wherein the agitator rollers are simultaneously rotated forward and backward, through a predetermined angle.

7. A machine according to claim 1, wherein said machine further comprises means for adjusting the rod-shaped objects such that the objects are orderly stacked in said container when the rod-shaped objects are being supplied into said container.

8. A machine according to claim 7, wherein adjusting means includes plural aligning rods longer than the diameter of the rod-shaped object and arranged under said stop rollers and in a horizontal direction, and means for simultaneously driving the aligning rods such that they reciprocate in the horizontal direction, at a certain stroke.

9. A machine according to claim 8, wherein said container is a box in shape, said container opening at the top and at that side thereof which faces one end face of each of the rod-shaped objects therein, and said adjusting means includes an arranging guide plate located to cover a part of the opened side of said container, and means for driving said arranging guide plate such that it reciprocates in the axial direction of the rod-shaped objects in said container, so as to arrange the ends of the rod-shaped objects along a same vertical plane in said container.

* * * * *